US006951484B2

(12) United States Patent
Tsuji

(10) Patent No.: US 6,951,484 B2
(45) Date of Patent: Oct. 4, 2005

(54) CONNECTOR

(75) Inventor: Takeshi Tsuji, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/006,347

(22) Filed: Dec. 7, 2004

(65) Prior Publication Data

US 2005/0085138 A1 Apr. 21, 2005

Related U.S. Application Data

(63) Continuation of application No. 10/442,540, filed on May 21, 2003.

(30) Foreign Application Priority Data

May 23, 2002 (JP) ..... 2002-149636
May 29, 2002 (JP) ..... 2002-155289

(51) Int. Cl.[7] ..... H01R 13/40
(52) U.S. Cl. ..... 439/595
(58) Field of Search ..... 439/595, 752

(56) References Cited

U.S. PATENT DOCUMENTS 5,575,683 A 11/1996 Saito et al.
5,595,509 A 1/1997 Fry et al.
5,769,664 A 6/1998 Saito et al.
6,123,574 A 9/2000 Matsuda et al.
6,322,391 B1 * 11/2001 Kodama ..... 439/595
6,332,803 B1 12/2001 Matsuda et al.
6,354,867 B1 3/2002 Tachi et al.
6,416,365 B1 7/2002 Iwahori
6,547,594 B2 4/2003 Ichio et al.
6,589,083 B2 * 7/2003 Kobayashi et al. ..... 439/752
6,626,701 B2 * 9/2003 Yoshida et al. ..... 439/595
6,641,437 B2 * 11/2003 Tsuji et al. ..... 439/595
6,679,729 B2 * 1/2004 Tanaka et al. ..... 439/595
6,736,675 B2 * 5/2004 Kato et al. ..... 439/595
6,796,836 B2 * 9/2004 Ichida et al. ..... 439/595
6,814,618 B2 * 11/2004 Ishikawa et al. ..... 439/595
6,835,097 B2 * 12/2004 Nankou et al. ..... 439/595
6,851,976 B2 * 2/2005 Ichida et al. ..... 439/595

FOREIGN PATENT DOCUMENTS

JP 04-102576 4/1992

* cited by examiner

*Primary Examiner*—Gary Paumen
(74) *Attorney, Agent, or Firm*—Gerald E. Hespos; Anthony J. Casella

(57) ABSTRACT

Cavity towers (14) forming front parts of cavities (11) project forward independently of each other from a back end surface (13A) of a mount space (13) formed in a housing (10) to mount a retainer (30). The cavity towers (14) are prevented from deformations by being coupled to the adjacent cavity towers (14) by couplings (26). Thus, when a pulling force acts backward on a terminal fitting (50), withdrawal of the terminal fitting (50) resulting from the deformation of the cavity tower (14) can be prevented. Therefore, the reliability of a function of locking the terminal fittings (50) can be improved.

9 Claims, 12 Drawing Sheets

CONNECTOR

This application is a continuation of application Ser. No. 10/442,540 filed May 21, 2003.

BACKGROUND OF THE INVENTION

1. Field of the Invention

The invention relates to a connector with a front retainer for doubly locking terminal fittings.

2. Description of the Related Art

Japanese Utility Model Publication No. 4-102576 discloses a known connector with a front retainer that has a housing with a plurality of cavities into which terminal fittings are insertable. A front retainer is mountable into a mount space formed in the housing. Cavity towers form front parts of the respective cavities and project independently of each other from the back end of the mount space in the housing. Each cavity of the housing has a resilient lock that is engageable with the terminal fitting. The front retainer enters deformation spaces for the locks to prevent the locks from being resiliently deformed in a direction disengaging from the terminal fittings.

The above-described connector, however, has no construction for supporting the respective cavity towers. A pulling force may act backward on the terminal fitting, for example, when a wire connected with the rear end of the terminal fitting is pulled before the retainer is mounted at a proper position. Thus, the terminal fitting may be inclined while remaining engaged with the lock, and may resiliently deform the cavity tower. A large deformation of cavity tower could displace the terminal fitting sufficiently to disengage from the lock. This causes a less reliable locking of the terminal fittings.

The invention was developed in view of the above problem and an object thereof is to provide a connector with more reliable terminal fitting locking.

SUMMARY OF THE INVENTION

The invention is directed to a connector with a housing that has opposite front and rear ends. Cavities extend through the housing from the front end to the rear end and are configured to receive terminal fittings inserted from an inserting direction. The cavities have locks for engaging and locking the corresponding terminal fittings. A retainer is mountable in a mount space in the housing from a mounting direction. The retainer enters deformation spaces for the locks to prevent the locks from being deformed out of engagement with the terminal fittings. Cavity towers form front parts of the respective cavities and project forward independently of each other from the back end of the mount space in the housing. At least one coupling is formed before the back end of the mount space between each pair of adjacent cavity towers to couple the cavity towers. The coupling substantially prevents deformation of the cavity towers. Thus, a backward pulling force on a wire will not deform the cavity towers in a way that could unlock the terminal fitting, and the terminal fittings are locked more reliably.

The cavity towers may be arranged in at least one row and are coupled to adjacent cavity towers in the respective row by the couplings. Cavity towers at the opposite ends of the row may have reinforcing ribs that extend forward from a side toward the back end of the mount space.

The cavity towers at the opposite ends of each row are coupled only to the cavity towers at one side. Thus, they may not have sufficient strength against deformation as compared to the other cavity towers coupled to the cavity towers at at least two opposite sides. However, the reinforcing ribs extend along forward and backward directions on the cavity towers at the opposite ends of the row to provide sufficient strength.

The retainer preferably is mountable at a full mount position where the retainer is fully accommodated in the mount space and at a partial mount position where the retainer is retracted forwardly from the mount space in a direction opposite to the mounting direction. The retainer preferably has engageable portions engageable with the cavity towers. The engageable portions prevent the leading ends of the cavity towers from being displaced when the retainer is at the partial mount position. Accordingly, deformations of the cavity towers can be prevented more securely.

Front-end surfaces of the coupling portions preferably align substantially with the front ends of the engageable portions of the retainer at the full mount position.

One or more locking projections preferably are engageable with corresponding receiving portions to hold the retainer at the full mount position and/or at the partial mount position.

According to a further preferred embodiment of the invention, the lock and/or the retainer comprise at least one slanted guiding surface for guiding the lock into engagement with the terminal fitting.

The lock preferably has an inverted T-shaped cross-section and preferably is transversely symmetrical.

The retainer may have a peripheral wall with a dimension along the longitudinal direction that is substantially equal to the depth of the mount space.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENT

A connector according to the invention is illustrated in FIGS. 1 to 12 and is comprised of a housing 10, a retainer 30, and terminal fittings 50. A side of the connector that mates with a mating connector (not shown) is referred to as the front in the following description.

Figure 1:
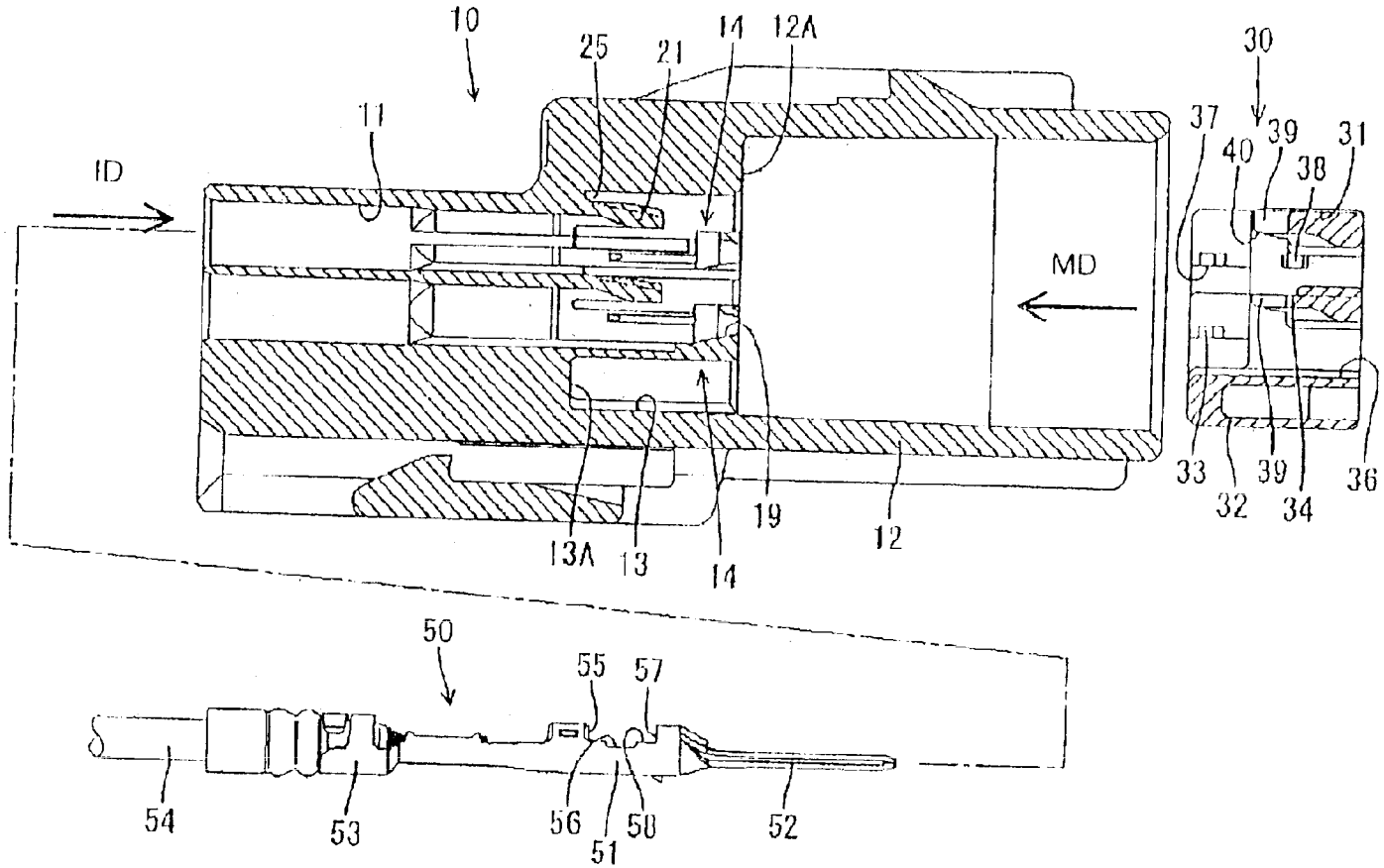
FIG. 1 is an exploded side view in section of a connector according to one embodiment of the invention.
Figure 2:
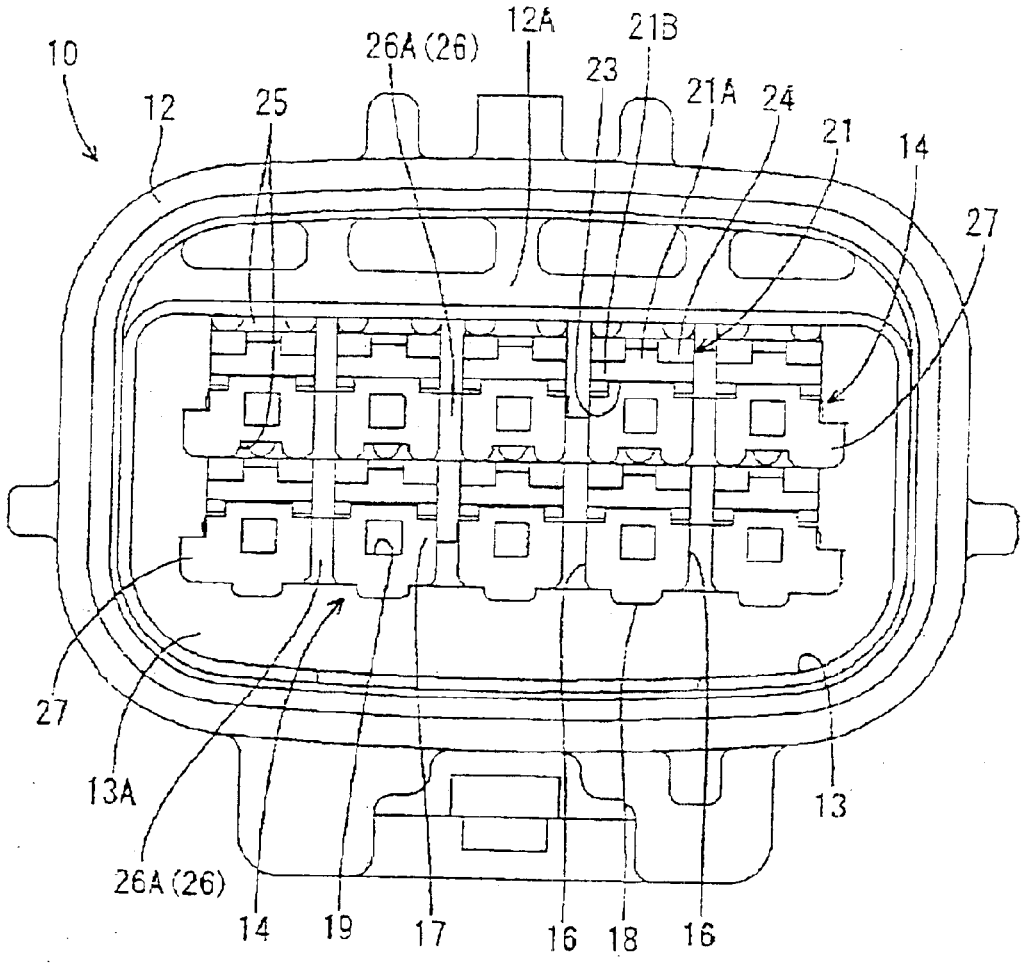
FIG. 2 is a front view of a housing.

The housing 10 is made e.g. of a synthetic resin, and cavities 11 that are hollow along forward and backward directions are formed in the housing 10. Five cavities 11 are arranged transversely at each of upper and lower stages as shown in FIG. 2. A receptacle 12 into which a mating female connector (not shown) is fittable is provided at the front part of the housing 10, and a back surface 12A of the receptacle 12 is recessed to form a mount space 13 into which the retainer 30 is fittable in a mounting direction MD.

Figure 3:
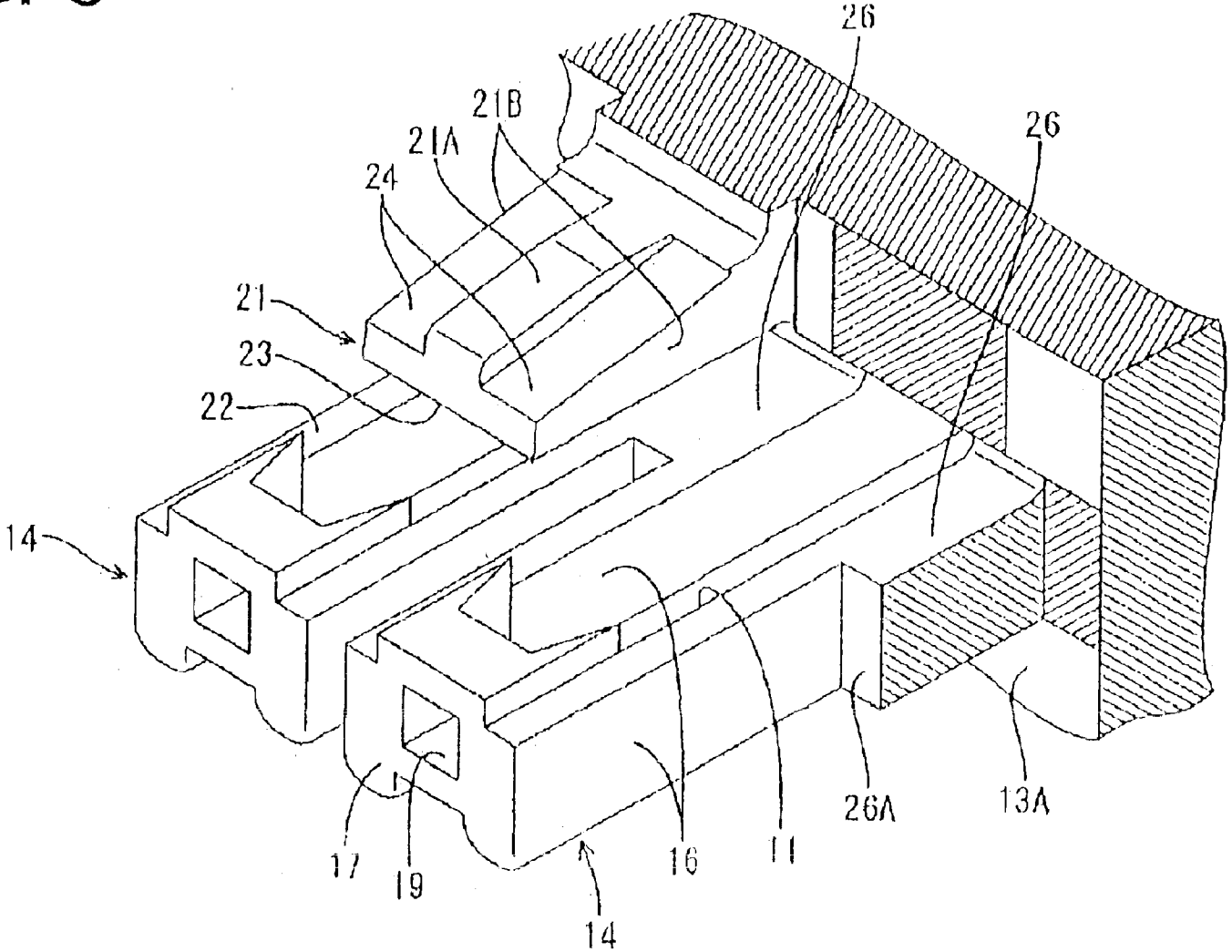
FIG. 3 is a partial enlarged perspective view showing cavity towers.

Cavity towers 14 form front parts of the respective cavities 11 and project into the mount space 13 from a back end surface 13A of the mount space 13. More specifically, as also shown in FIG. 3, each cavity tower 14 at the upper stage is formed by left and right side walls 16 and a front wall 17 that couples the front ends of the opposite side walls 16. Each cavity tower 14 at the lower stage is formed by left and right side walls 16, a front wall 17 coupling the front ends of the opposite side walls 16, and a bottom wall 18 substantially continuous with the bottom edges of the side walls 16 and the front wall 17. The respective cavity towers 14 project forward independently of the other cavity towers 14. Each front wall 17 is formed with a tab hole 19 for permitting a tab 52 of the terminal fitting 50 to project out of the cavity 11. Further, the front end surface of each front wall 17 is slightly behind the back surface 12A of the receptacle 12.

The upper surface of each cavity tower 14 in an area between the opposite sidewalls 16 is open, and a substantially rear half of this opening is substantially covered from above by a lock 21 formed in the housing 10. More particularly, the housing 10 has locks 21 that cantilever forward from the back end surface 13A of the mount space 13 substantially along the opening in the upper surface of the corresponding cavity 11. Each lock 21 is resiliently deformable up and down. Additionally, each lock 21 has a transversely symmetrical inverted T-shaped cross section when viewed from the front. Thus, a thick portion 21A is defined at a widthwise middle of each lock 21 and has a larger vertical dimension along the deforming direction, while thin portions 21B are defined at the left and right sides of the thick portion 21A and have smaller vertical dimensions than the thick portion 21A. The lower surfaces of the thick portion 21A and the thin portions 21B are substantially continuous and flush with each other. However, the thick portion 21A projects more upward than the thin portions 21B on the upper surface of the lock 21.

Slit-shaped clearances extend in forward and backward directions between the left and right edges of each lock 21 and the upper edges of the opposite sidewalls 16. A receiving surface 22 is defined at the upper surface of each sidewall 16 facing the bottom surface of the corresponding lateral end of the lock 21. The receiving surface 22 is substantially parallel with an inserting direction ID of the terminal fitting 50 into the cavity 11 and functions to limit downward displacement of the lock 21.

A locking section 23 is formed at the front bottom end of each lock 21 for engaging and locking the terminal fitting 50. The locking section 23 projects down into an insertion space in the cavity 11 for the terminal fitting 50 in a free unbiased and undeformed state of the lock 21. Further, slanted guide surfaces 24 slope down and to the front on the upper surfaces of the thin portions 21B of the lock 21.

A deformation space 25 is formed in each cavity 11 above the lock 21 for permitting an upward resilient deformation of the lock 21. Each deformation space 25 is open at the front end of the housing 10. Deformation spaces 25 for the locks 21 at the lower stage communicate with the cavities 11 at the upper stage in areas corresponding to the thick portions 21A of the locks 21. The locks 21 at the lower stage are positioned to partition the cavities 11 at the adjacent upper stage from those at the lower stage.

Figure 4:
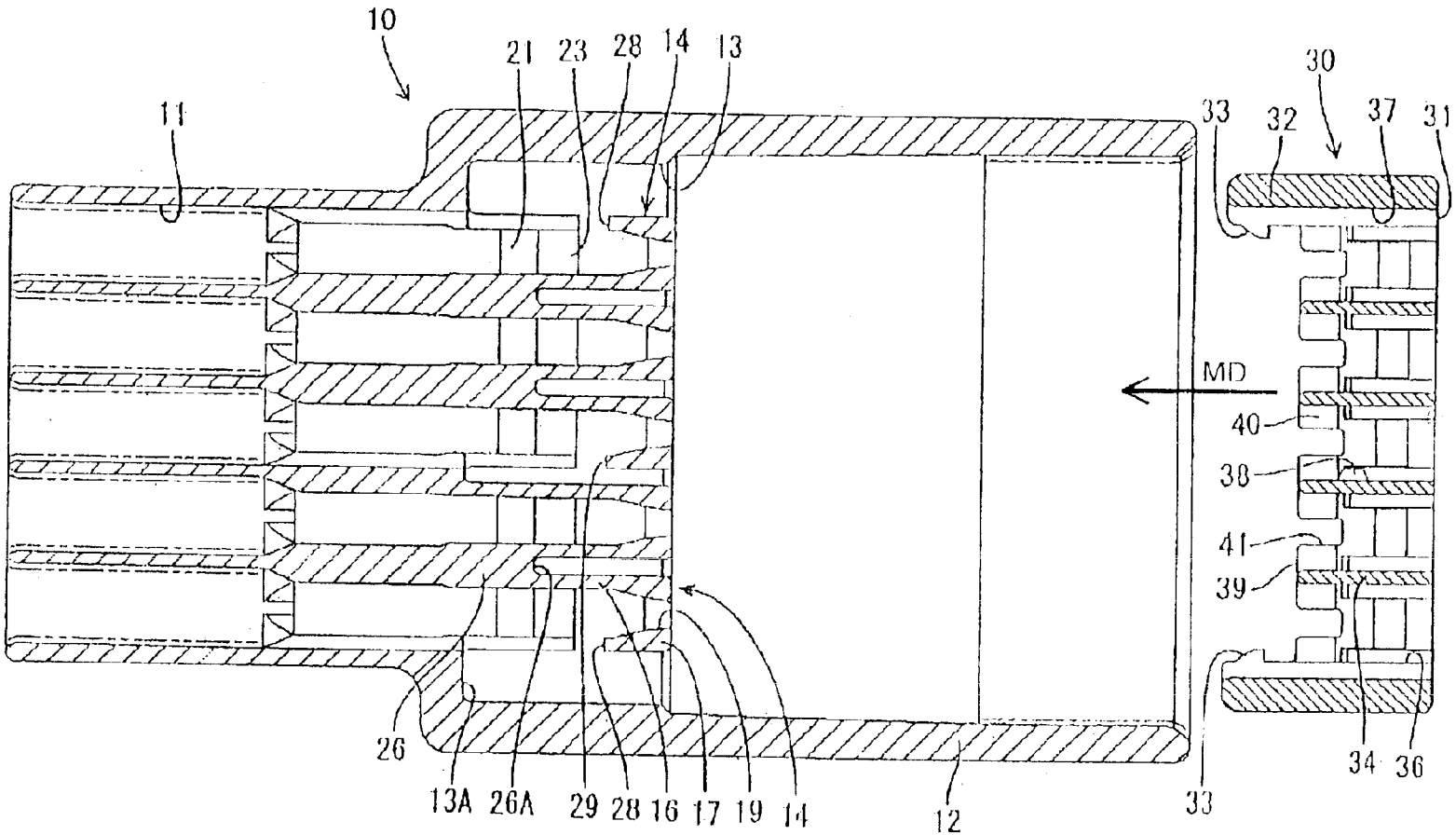
FIG. 4 is a plan view in section showing a state before the housing and a retainer are assembled.
Figure 5:
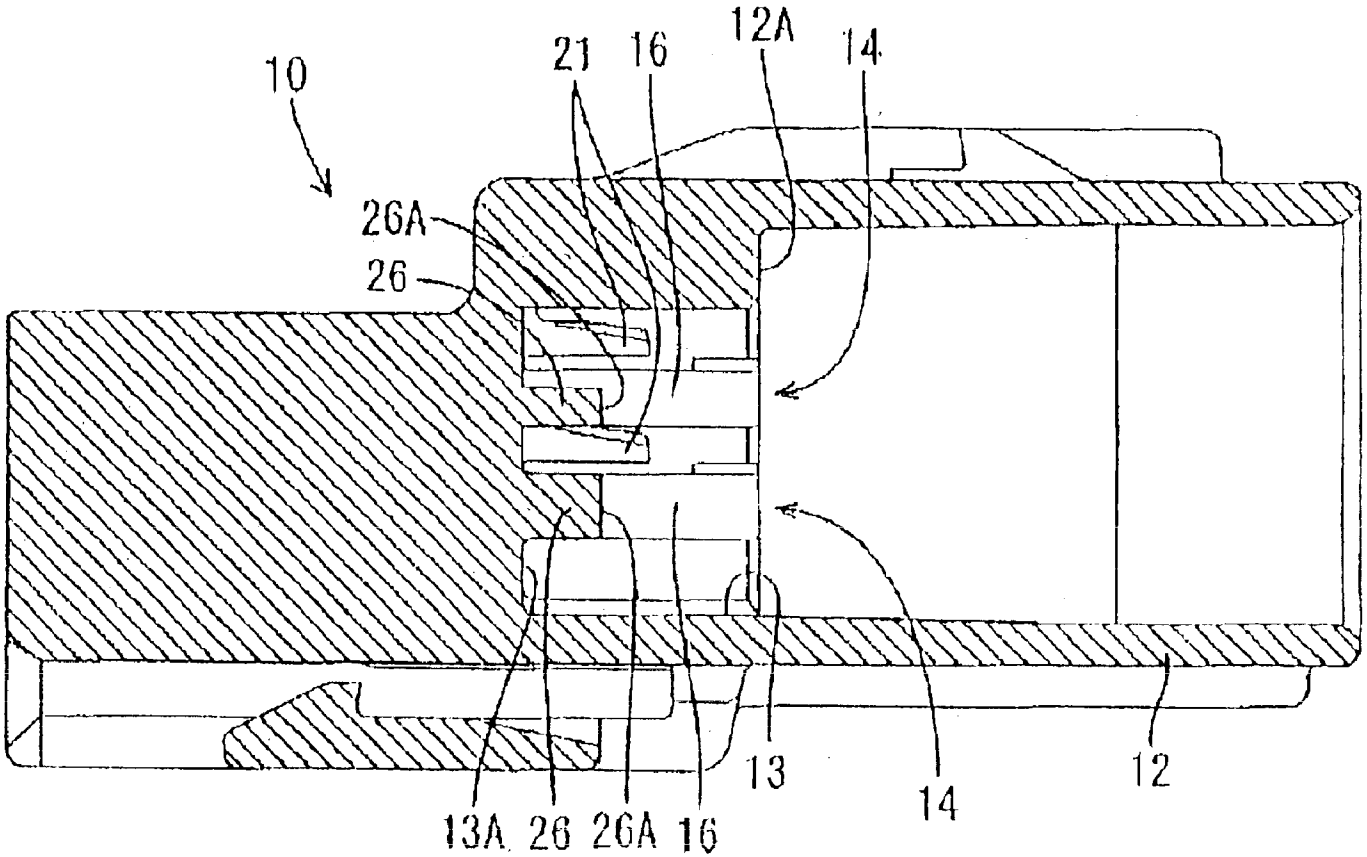
FIG. 5 is a side view in section of the housing.
Figure 6:
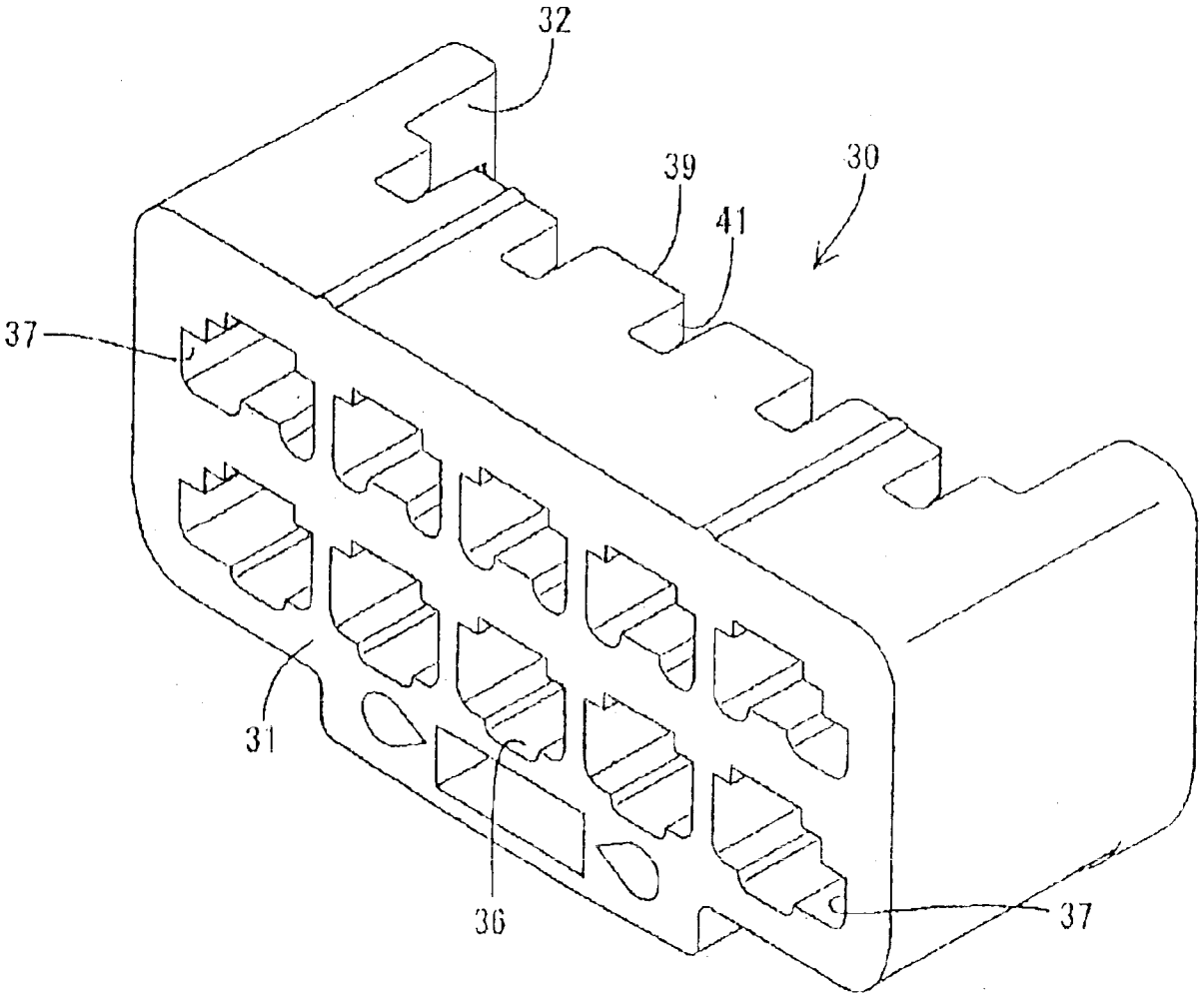
FIG. 6 is a perspective view of the retainer.
Figure 7:
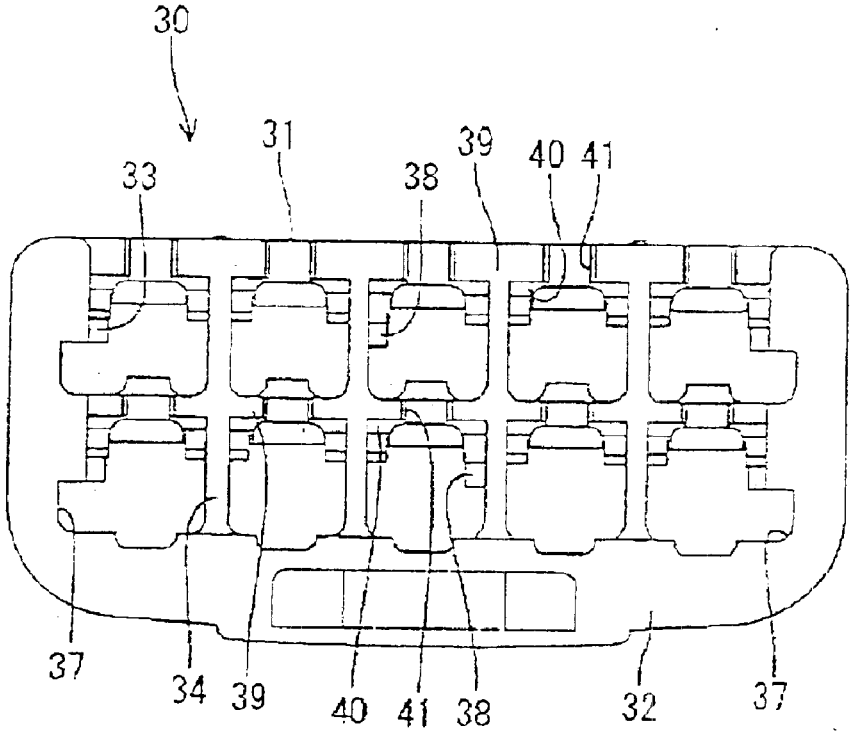
FIG. 7 is a rear view of the retainer.
Figure 8:
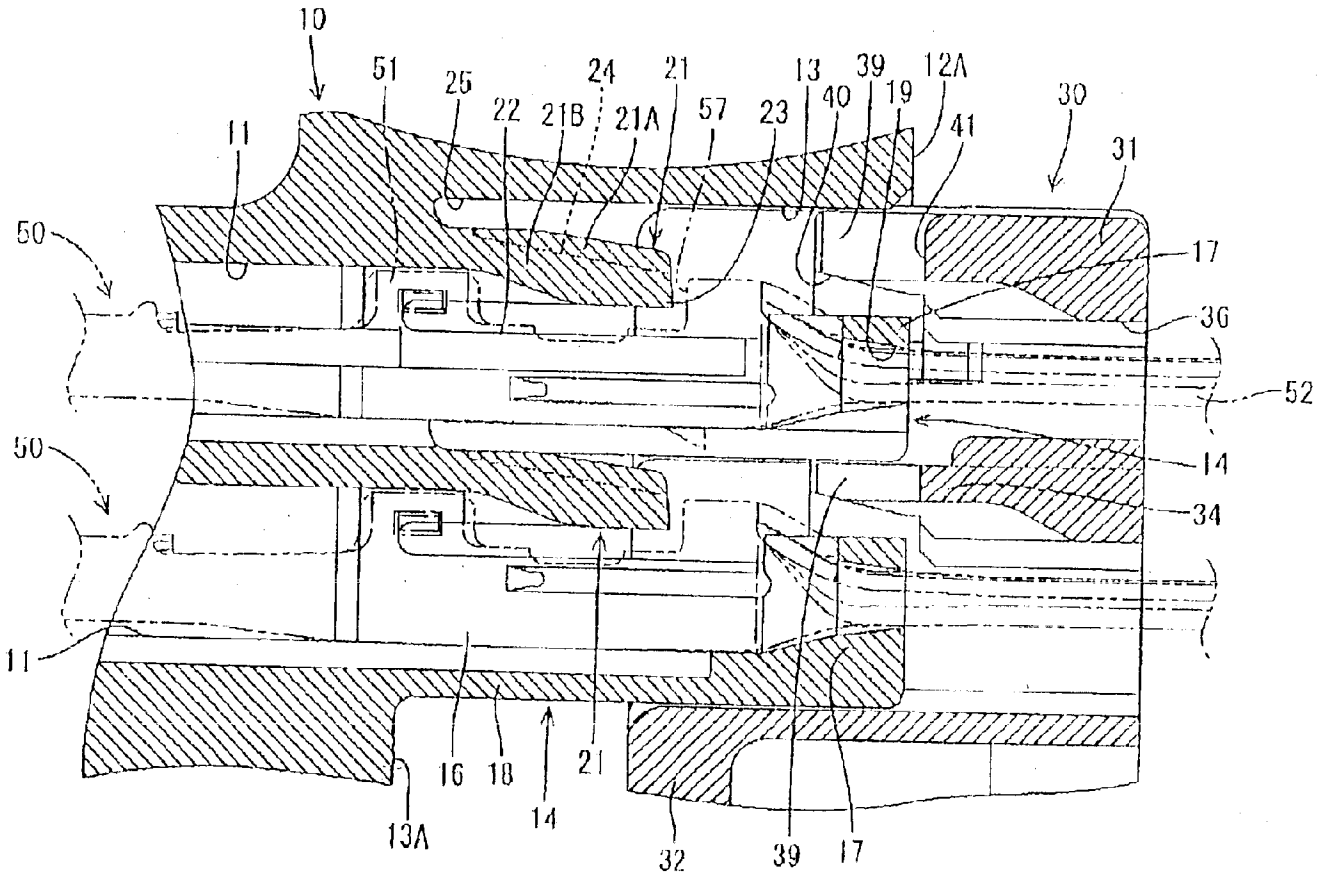
FIG. 8 is a partial enlarged side view in section showing a state where the retainer is mounted at a partial mount position.
Figure 9:
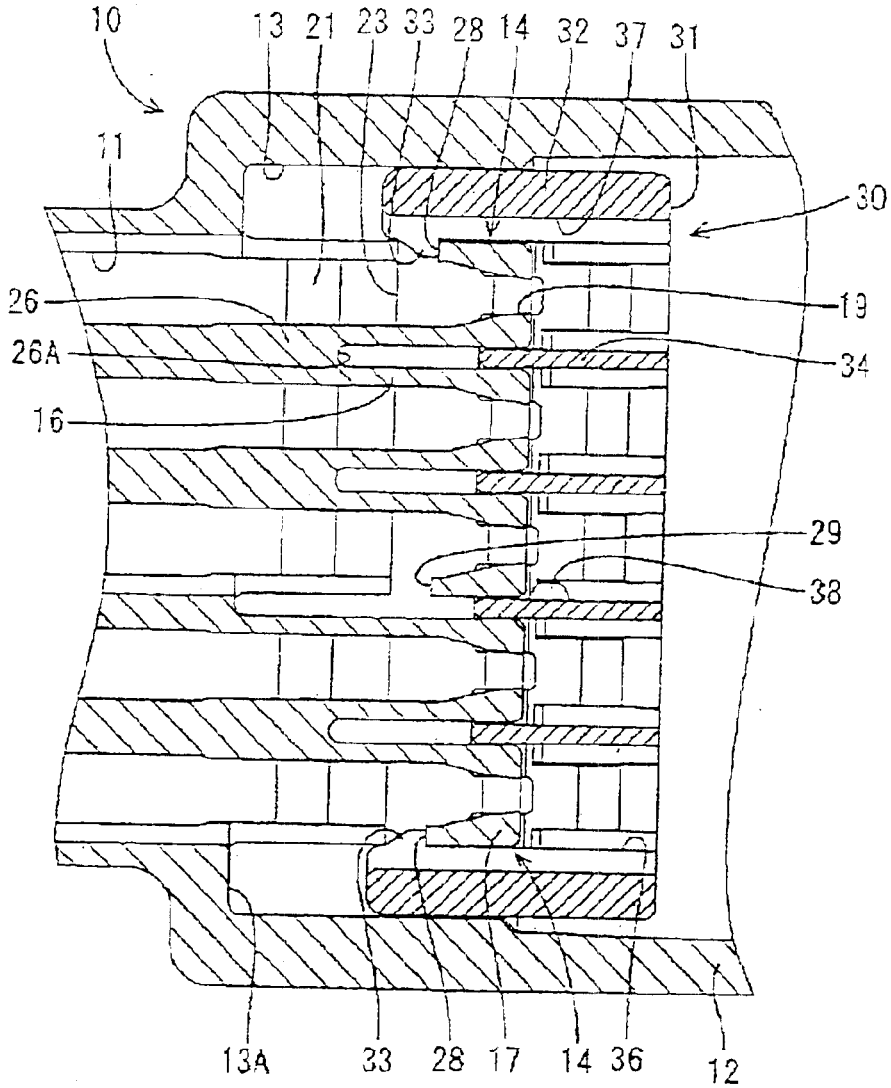
FIG. 9 is a plan view in section showing the state of FIG. 8.

Coupling portions 26 are formed between transversely adjacent cavity towers 14 and couple the sidewalls 16 of transversely adjacent towers 14 at the base end. As shown in FIGS. 3 to 5, the coupling portions 26 have substantially the same thickness as the sidewalls 16 and project forward from the back end surface 13A of the mount space by a specified distance. Further, as shown in FIG. 2, reinforcing ribs 27 bulge out in a widthwise direction from the cavity towers 14 located at the opposite left and right ends of the respective stages and extend along forward and backward directions. The reinforcing ribs 27 extend substantially from the back end surface 13A of the mount space 13 to the front ends of the cavity towers 14.

The retainer 30 is made e.g. of a synthetic resin and is mountable into the housing 10 from the front along a mounting direction MD. The retainer 30 has a front wall 31 and a substantially U-shaped peripheral wall 32 projects back from the bottom edge and the left and right edges of the rear surface of the front wall 31, as shown in FIGS. 1, 4, 6 and 7. The retainer 30 is movable between a full mount position and a partial mount position. In the full mount position, the retainer 30 is accommodated entirely in the mount space 13 (see FIGS. 10 to 12). However, the retainer 30 at the partial mount position is retracted forward from the mount space 13 (see FIGS. 8 and 9). A dimension of the peripheral wall 32 along forward and backward directions is substantially equal to the depth of the mount space 13. Thus, the rear surface of the peripheral wall 32 substantially abuts the back end surface 13A of the mount space 13 and the front surface of the front wall 31 is substantially aligned with the back surface 12A of the receptacle 12 when the retainer 30 is at the full mount position. Further, as shown in FIG. 4, upper and lower engaging claws 33 project at positions of each of the left and right inner surfaces of the peripheral wall 32 near the rear end. On the other hand, engaging grooves 28 extend along forward and backward directions in the outer sidewalls 16 of the cavity towers 14 at the left and right end positions of the respective stages. The retainer 30 is held to be displaceable between the full mount position and the partial mount position along the mounting direction MD by engaging the engaging claws 33 of the retainer 30 with the engaging grooves 28.

Engageable portions 34 are formed at the rear side of the front wall 31 of the retainer 30 and are individually engageable with the respective cavity towers 14 without shaking in vertical and/or transverse directions. The cavity towers 14 are arranged vertically and transversely. Thus, the engageable portions 34 form a substantially rectangular lattice when seen as an aggregate. Each engageable portion 34 is a substantially rectangular tube and is engageable in substantially surrounding relationship with the corresponding cavity tower 14. The leading ends of the cavity towers 14 enter the engageable portions 34 when the retainer 30 is at the partial mount position to prevent downward and/or transverse displacements of the leading ends of the cavity towers 14. The front wall 31 of the retainer 30 is formed with through holes 36 that correspond to the tab holes 19 of the cavities 11 for permitting insertion of the tabs 52 of the terminal fittings 50. Receiving grooves 37 extend from the rear end of the inner side surfaces of the peripheral wall 32 through the front wall 31 along forward and backward directions and are disposed to receive and engage the reinforcing ribs 27 of the cavity towers 14 at the opposite ends of the respective stage.

As shown in FIG. 4, a locking projection 38 is formed on the inner side surface of each of the upper and lower engageable portions 34 at substantially the widthwise center of the front wall 31. On the other hand, a groove-shaped receiving portion 29 is formed in the sidewall 16 of the corresponding cavity tower 14 at substantially the widthwise center. The retainer 30 is held at the full mount position by engaging the locking projections 38 of the retainer 30 with the receiving portions 29. Front-end surfaces of the engageable portions 34 and front-end surfaces 26A of the coupling portions 26 substantially align when the retainer 30 is at the full mount position.

Fittable portions 39 corresponding to the thin portions 21B of the respective locks 21 are formed at an upper part of each engageable portion 34. The fittable portions 39 form a part of the engageable portion 31 surrounding the cavity tower 14. Slanted pressing surfaces 40 substantially corresponding to the slanted guide surfaces 24 of the lock 21 are formed on the lower surfaces of the fittable portions 39. Each fittable portion 39 is formed with an escaping groove 41 for avoiding interference with the thick portion 21A of the lock 21.

The fittable portions 39 are spaced forward from the locks 21 when the retainer 30 is at the partial mount position. However, the respective fittable portions 39 fit into the deformation spaces 25 when the retainer 30 is moved in the mounting direction MD to the full mount position. The fittable portions 39 that fit into the deformation spaces 25 at the upper stage thrust themselves between the ceiling surfaces of the deformation spaces 25 and the upper surfaces of the thin portions 21B of the locks 21. Thus, the slanted pressing surfaces 40 of the retainer 30 press the slanted guide surfaces 24 of the locks 21 down toward the terminal fitting 50. The fittable portions 39 that fit into the deformation spaces 25 at the lower stage thrust themselves between the bottom end surfaces of the side walls 16 forming the cavities 11 at the upper stage and the upper surfaces of the thin portions 21B. Thus, the slanted pressing surfaces 40 of the retainer 30 press the slanted guide surfaces 24 of the locks 21 down toward the terminal fitting 50. In this way, the respective locks 21 are forcibly pressed down from their free unbiased states toward the terminal fittings 50, and are prevented from being resiliently deformed toward the deformation spaces 25 and away from the terminal fittings 50.

Each terminal fitting 50 is formed by bending, folding and/or embossing a metallic plate material stamped or cut out into a specified shape and is narrow and long in forward and backward directions. A substantially longitudinal middle portion of the terminal fitting 50 is a substantially rectangular tube 51. The tab 52 extends forward from the rectangular tube 51, and a wire connection portion 53 at the rear end of the terminal fitting 50 is crimped, bent or folded into connection with a wire 54, or is connectable therewith by other means, such as insulation displacement, soldering, welding or the like. The terminal fitting 50 is inserted from behind into the corresponding cavity 11 in the insertion direction ID.

An upper cut-away portion 55 extends over substantially the entire width in part of the upper plate of the rectangular tube 51, and side cut-away portions 56 are formed at the upper ends of the left and right side plates of the rectangular tube 51 and align with the upper cut-away portion 55. The front edges of these cut-away portions 55, 56 serve as a fastening portion 57 engageable with the locking section 23 of the corresponding lock 21. Substantially horizontally extending upper edges of the side cut-away portions 56 define displacement-preventing portions 58 for limiting displacement of the locking section 23 at the extending end of the lock 21 toward the terminal fitting 50. The displacement preventing portions 58 of the terminal fittings 50 are at substantially the same height as the receiving surfaces 22 of the sidewalls 16 forming the cavities 11.

The connector is assembled by first mounting the retainer 30 into the mount space 13 of the housing 10. Thus, the peripheral wall 32 is inserted into the mount space 13 and the reinforcing ribs 27 of the cavity towers 14 at the opposite ends of the respective stages enter and engage the receiving grooves 37 to guide the insertion of the retainer 30. The engaging claws 33 engage the engaging grooves 28 when the retainer 30 is pushed in the mounting direction MD to the partial mount position (see FIGS. 8 and 9). In this partly mounted state, the fittable portions 39 are spaced forward from the front ends of the locks 21, and the locks 21 can deform toward the deformation spaces 25. Further, the leading ends of the cavity towers 14 enter the engageable portions 34 and are prevented from deforming in vertical and/or transverse directions.

Each terminal fitting 50 then is inserted in the inserting direction ID into the corresponding cavity 11. The front end of the upper surface of the rectangular tube 51 contacts the lower surface of the lock 21 when the terminal fitting 50 approaches a proper insertion position. The lock 21 then is deformed resiliently up and enters the deformation space 25 as the terminal fitting 50 is further inserted.

The lock 21 resiliently returns when the terminal fitting 50 reaches the proper insertion position. Thus, the locking section 23 at the front end of the lock 21 projects into the cut-away portions 55, 56 of the rectangular tube 51 to engage the fastening portion 57 from behind. The terminal fitting 50 is locked by the engagement with the lock 21 and is prevented from making backward movements in the withdrawing direction. Additionally, the rectangular tube 51 contacts the front wall 17 of the cavity 11 when the terminal fitting 50 is at the proper insertion position and cannot move any further forward.

The lock 21 is substantially in its free unbiased state and is undeformed when the terminal fitting 50 is inserted to its proper position. Additionally, vertical clearances are defined between the locking section 23 of the lock 21 and the displacement preventing portions 58 of the terminal fitting 50 and between the locking section 23 and the receiving surfaces 22. Thus, the lock 21 can be deformed down by an amount equal to the vertical dimension of these clearances.

A pulling force could act backward on the terminal fitting 50 if, for example, the wire 54 is pulled. Such forces on the terminal fitting 50 could cause the cavity tower 14 to deform in downward and/or transverse directions. Accordingly the terminal fitting 50 could be disengaged from the lock 21 and withdrawn from the cavity 11. However, the base ends of the adjacent cavity towers 14 are coupled by the coupling portions 26 and are prevented from deforming. Further, leading ends of the cavity towers 14 are inserted in the engageable portions 34 and hence are prevented from deforming. The cavity towers 14 at the ends of the respective stages are prevented from deforming by the reinforcing ribs 27. As a result, the cavity towers 14 cannot be deformed and the terminal fittings 50 are prevented from coming out.

Figure 10:
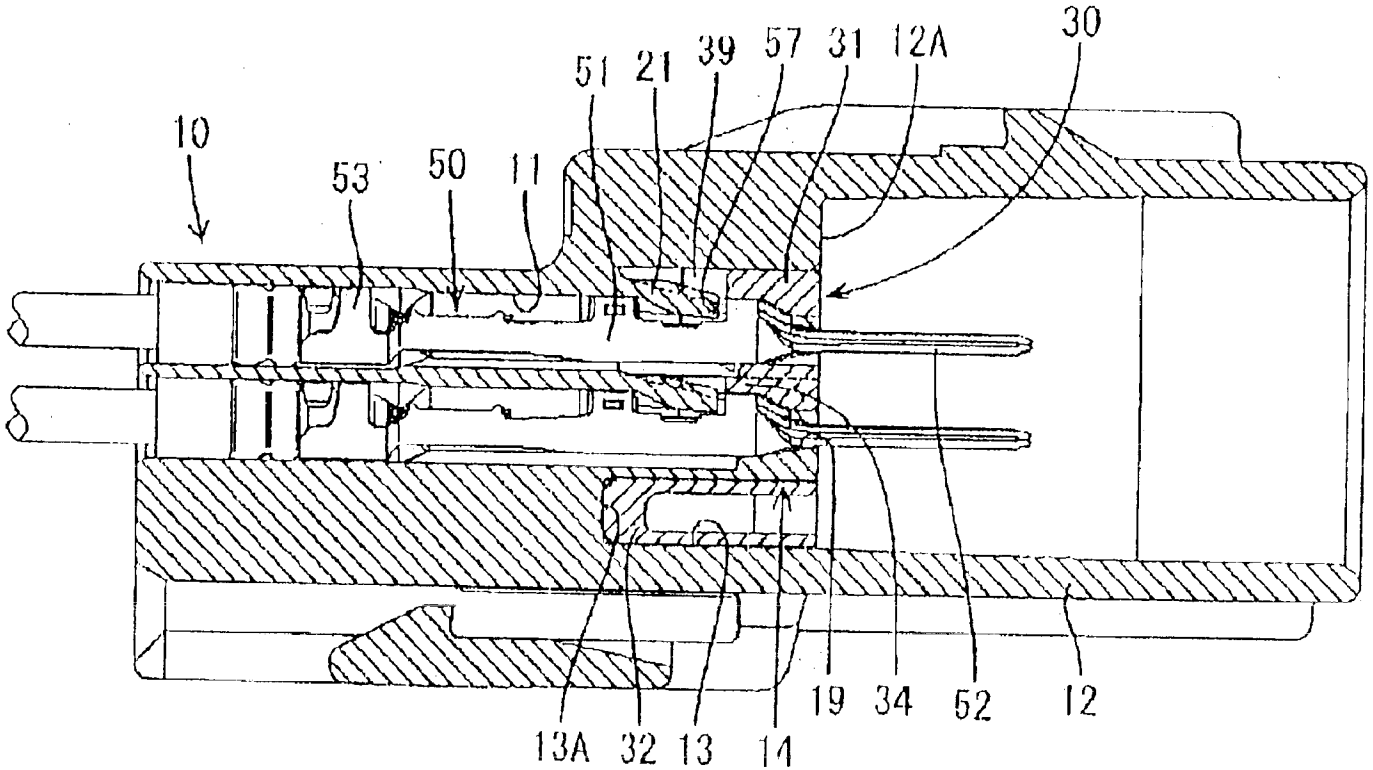
FIG. 10 is a side view in section showing a state where the retainer is mounted at a full mount position.
Figure 11:
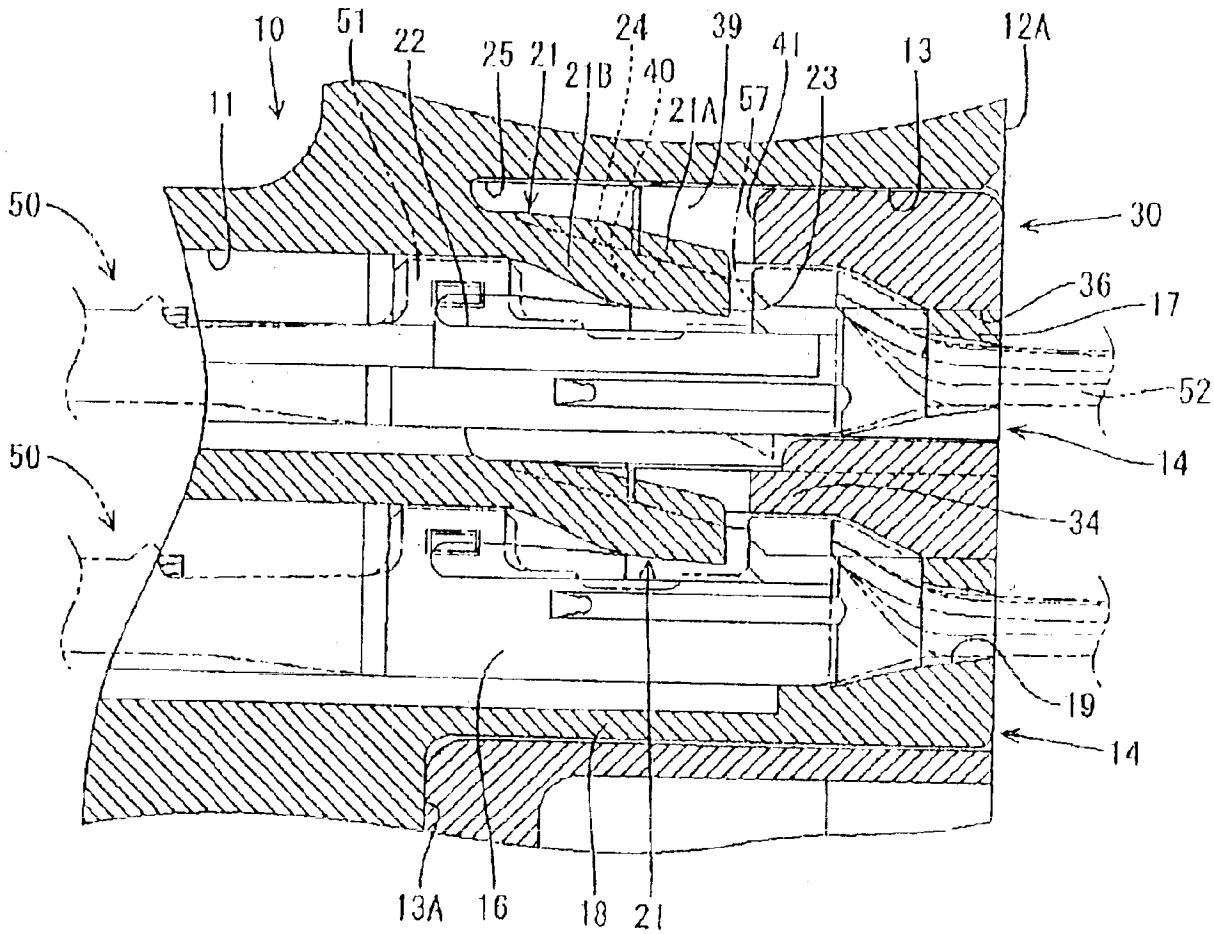
FIG. 11 is a partial enlarged side view in section showing the state of FIG. 10.
Figure 12:
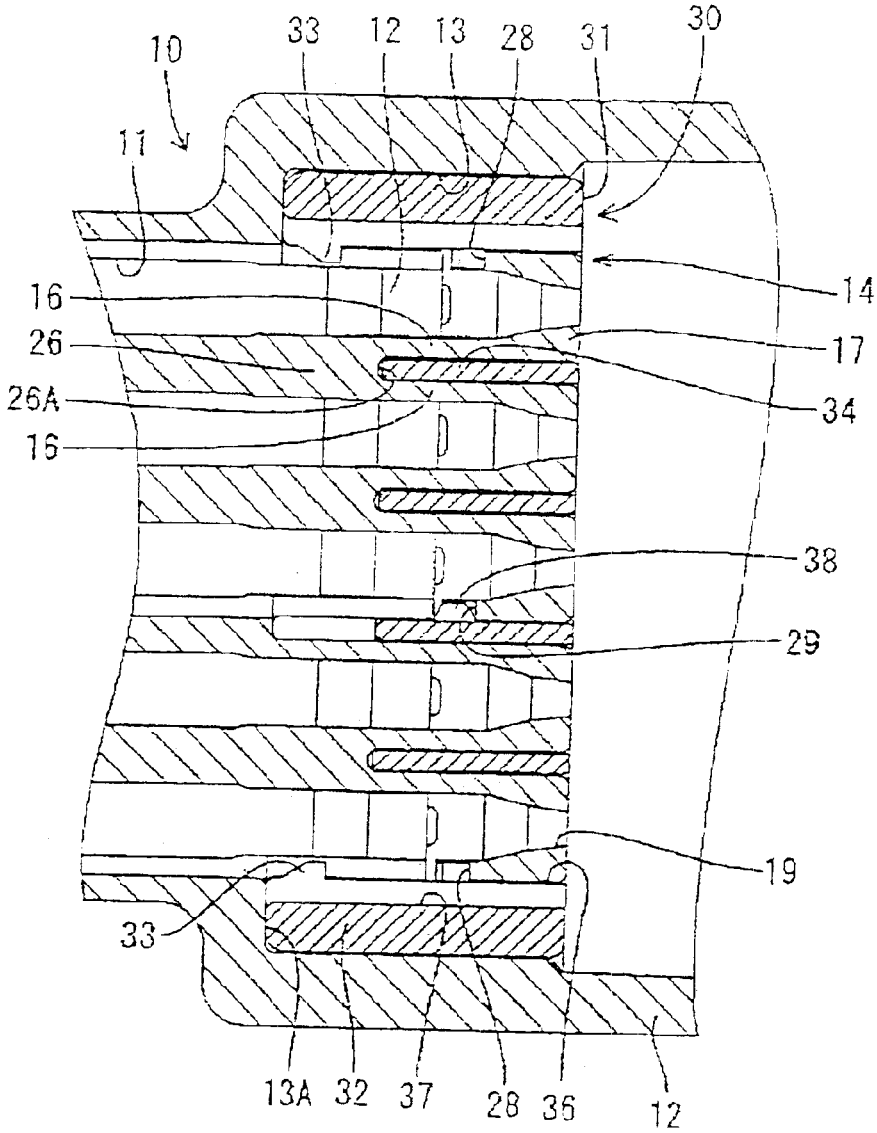
FIG. 12 is section similar to FIG. 9, but showing the state of FIG. 10.

The retainer 30 is pushed in the mounting direction MD from the partial locking position to the full mount position shown in FIGS. 10 to 12 after all terminal fittings 50 have been inserted. In the process of pushing the retainer 30, the fittable portions 39 enter the respective deformation spaces 25 and the slanted pressing surface 40 contacts the slanted guiding surfaces 24 of the locks 21. The retainer 30 then is pushed further, and the slanted pressing surfaces 40 push the slanted guiding surfaces 24 down. Thus, the locks 21 are deformed forcibly from their free states toward the terminal fittings 50 to incline down toward the front as compared to their free state. This displacement increases a vertical dimension of an area of engagement between the locking section 23 of the lock 21 and the fastening portion 57 of the terminal fitting 50, as compared to a case where the lock 21 is unbiased. The lock 21 has the thin portions 21B pressed from above by the fittable portions 39. Therefore the lock 21 is prevented from being deformed up toward the deformation space 25 and is held engaged with the terminal fitting 50. In this way, the terminal fitting 50 is locked doubly and is prevented securely from coming out.

After the retainer 30 is pushed to the full mount position, the locking projections 38 are engaged with the receiving portions 29 to hold the retainer 30 at the full mount position. Further, the engageable portions 34 are fit deeper on the respective cavity towers 14 at the full mount position than at the partial mount position. Therefore, deformations of the cavity towers 14 in vertical and/or transverse directions can be prevented more securely.

A strong backward pulling force on the terminal fitting 50 could buckle the lock 21 so that a portion of the lock 21 between the locking section 23 and a supporting point at a rear end of the lock 21 bulges out toward the deformation space 25. However, in this embodiment, the retainer 30 presses the locks 21 to incline them down to the front and the fittable portions 39 of the retainer 30 contact the upper surfaces of the locks 21 at positions behind the locking sections 23. Thus, the locking sections 23 of the locks 21 are held substantially in contact with the receiving surfaces 22 and the displacement preventing portions 48 and are prevented from downward displacements. Thus, even if a backward pulling force acts on the terminal fitting 50 and the locking section 23, there is no possibility that the lock 21 will buckle.

As described above, the cavity towers 14 are coupled to the adjacent cavity towers 14 by the coupling portions 26 and hence will not deform when a backward pulling force acts on the terminal fitting 50. Thus, the withdrawal of the terminal fitting 50 resulting from the deformation of the cavity tower 14 is prevented, and a more reliable locking of the terminal fittings 50 is achieved.

The front-end surfaces 26A of the coupling portions 26 are substantially aligned with the front-ends of the engageable portions 34 of the retainer 30 at the full mount position. Thus, there is no dead space between the retainer 30 and the back end surface 13A of the mount space 13, thereby eliminating the wastefulness of space.

Cavity towers 14 at the opposite ends of a row are coupled only to the cavity towers 14 at one side. Thus, they may not have sufficient strength against deformation as compared to the cavity towers 14 coupled to the cavity towers at both opposite sides. However, the reinforcing ribs 27 extend along forward and backward directions on the cavity towers 14 at the opposite ends to ensure sufficient strength.

Furthermore, the reinforcing ribs 27 engage the receiving grooves 37 of the retainer 30 to guide the retainer 30 through a smooth mounting.

Leading ends of the cavity towers 14 are prevented from displacements by entering the engageable portions 34 with the retainer 30 mounted at the partial mount position. Thus, deformations of the cavity towers 14 can be prevented more securely.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

A male connector with male terminal fittings is described in the foregoing embodiment. However, the invention is also applicable to female connectors with female terminal fittings.

Each coupling couples the base ends of a pair of adjacent cavity towers in the foregoing embodiment. However, the coupling may couple the leading ends or intermediate portions of a pair of adjacent cavity towers. like a bridge, according to the present invention.

Cavity towers arranged transversely in a row are coupled by the couplings in the foregoing embodiment. However, vertically arranged cavity towers may be coupled by the couplings according to the invention or couplings may couple adjacent cavity towers both vertically and horizontally.

What is claimed is:

1. A connector comprising: a housing having opposite front and rear ends, a forwardly open mount space extending rearwardly into the housing and having a forwardly facing back end surface, a plurality of towers projecting forwardly into the mount space from the back end surface thereof, each said tower having first and second spaced apart sidewalls having opposed inner surfaces defining a cavity therebetween and opposed outer surfaces defining a width for the tower, a tab hole at a front end of the tower providing communication into the cavity, each said tower having at least one opening extending completely between the first and second sidewalls of the tower, a plurality of resiliently deflectable locks formed unitarily with the housing and cantilevered forwardly from the back end surface of the mount space and associated respectively with the towers, each said lock being opposed to at least a rear portion of the opening of the respective tower and having a width wider than the respective cavity at locations opposed to the lock.

2. The connector of claim 1, wherein each of the locks has a width substantially equal to the width of the tower.

3. The connector of claim 1, further comprising couplings projecting forwardly from the back end surface of the mount space and connecting sidewalls of adjacent towers from the back end surface of the mount space to a location intermediate the back end of the mount space and the front end of the respective towers for reinforcing the towers.

4. The connector of claim 3, wherein each of said couplings has a front end aligned with intermediate positions along the locks.

5. The connector of claim 3, wherein the plurality of towers comprise a side-by-side array of upper stage towers and a side-by-side array of lower stage towers, the couplings extending between adjacent towers in the upper stage and between adjacent towers in the lower stage.

6. The connector of claim 3, wherein the opening in each said tower is a first opening, and wherein each said tower further includes a second opening extending between the sidewalls and on a side of the tower opposite the first opening.

7. The connector of claim 1, further comprising a plurality of terminal fittings, each said terminal fitting having a rear end connected to a wire and a rectangular tube forward of the rear end, the rectangular tubes of the terminal fittings being disposed respectively in the cavities of the towers and being dimensioned so that a portion of the rectangular tube project projects through the opening between the sidewalls of the respective tower and into the mount space each of the rectangular tubes having front and rear ends in the cavity and an opening between the front and rear ends and in a portion of the rectangular tube projecting into the mount space, the lock projecting into the opening and engaging a front edge of the opening in the rectangular tube.

8. The connector of claim 1, further comprising a retainer mounted to the towers and movable between a partial mount position and a full mount position in the mount space, the retainer having fittable portions disposed forwardly of the locks when the retainer is in the partial lock position, the fittable portions engaging surfaces of the locks opposite the associated tower when the retainer is in the full lock position for substantially preventing resilient deformation of the locks away from the associated towers.

9. The connector of claim 8, wherein each fittable portion of the retainer has a free end spaced forwardly from the back end surface of the mount space when the retainer is in the full lock position.

* * * * *